US006101896A

United States Patent [19]

Engelgau

[11] Patent Number: 6,101,896

[45] Date of Patent: Aug. 15, 2000

[54] INTEGRAL PEDAL ARM AND SWITCH HOUSING

[75] Inventor: Steven J. Engelgau, Royal Oak, Mich.

[73] Assignee: Teleflex Incorporated, Plymouth Meeting, Pa.

[21] Appl. No.: 09/231,393

[22] Filed: Jan. 13, 1999

[51] Int. Cl.[7] ..... G05G 1/14; H01H 3/14

[52] U.S. Cl. ..... 74/560; 74/512; 74/513; 123/399; 200/61.89

[58] Field of Search ..... 74/512, 513, 560; 123/399; 701/1; 200/61.89, 86.5, 330, 332.1, 339, 557

[56] References Cited

U.S. PATENT DOCUMENTS

| | | | |
|---|---|---|---|
| 2,822,441 | 2/1958 | Fortney . | |
| 2,832,863 | 4/1958 | Quimby . | |
| 3,219,775 | 11/1965 | Carpenter | 200/61.89 |
| 3,439,323 | 4/1969 | Kersting | 74/512 X |
| 3,766,342 | 10/1973 | Stadelmann . | |
| 4,455,466 | 6/1984 | Wilson . | |
| 4,695,819 | 9/1987 | Bowsher | 74/560 X |
| 4,950,850 | 8/1990 | Kamimura et al. . | |
| 4,958,607 | 9/1990 | Lundberg | 123/399 |
| 5,051,550 | 9/1991 | Harris . | |
| 5,133,225 | 7/1992 | Lundberg et al. | 74/560 |
| 5,237,891 | 8/1993 | Lundberg et al. . | |
| 5,319,996 | 6/1994 | Harris | 74/560 |
| 5,439,275 | 8/1995 | Padula et al. . | |
| 5,497,677 | 3/1996 | Baumann | 74/513 |
| 5,934,152 | 8/1999 | Aschoff et al. | 74/513 |

FOREIGN PATENT DOCUMENTS

| | | | |
|---|---|---|---|
| 3431360 A1 | 3/1986 | Germany | 200/61.89 |
| 617748 | 2/1961 | Italy | 200/61.89 |
| 58-77132 | 5/1983 | Japan | 123/399 |
| 2022320 | 12/1979 | United Kingdom | 200/61.89 |
| 2102923 | 2/1983 | United Kingdom | 200/61.89 |

*Primary Examiner*—Vinh T. Luong
*Attorney, Agent, or Firm*—Howard & Hwoard

[57] ABSTRACT

A pedal arm and switch assembly (40) for use in a vehicle (10) wherein a switch housing (62) is integral with the plastic pedal arm (50) and supports the switch (60). The switch (60) is normally spaced apart from an adjacent surface (66) when the pedal (50) is in a normally biased position (P). The surface (66) may either be a pedal assembly bracket portion (47) or a firewall (14). The switch (60) has a pin (64) that extends from the housing (62) and is actuated when the pin (64) contacts the surface (66). The switch (60) produces an electronic signal upon actuation in response to the pedal arm (50) reaching one of a first (P1) and second (P2) predetermined positions. The electronic signal may control a cruise control system (34), brake lights (42), or a transmission gear shifter (20).

5 Claims, 2 Drawing Sheets

CPU
44
52
40
74
34
50
66
20
64
70
72
76
74
60
68
62
42
54
56
D
P
P2
P1

INTEGRAL PEDAL ARM AND SWITCH HOUSING

BACKGROUND OF THE INVENTION

1. Field of the Invention

This invention relates to vehicle brake and clutch pedal assemblies.

2. Description of the Prior Art

Vehicle brake pedal assemblies function not only to apply the brakes and decelerate the vehicle, but also to act as an input to other control devices which rely on the position of the brake pedal assembly. To provide this input for other control devices, some brake pedal assemblies have incorporated electronic switches that are connected at one end to the brake pedal assembly and at the other end to a portion of the vehicle's interior, as shown in U.S. Pat. No. 3,766,342. The problem with that type of switch configuration is that the switch is mounted on the exterior of the pedal arm. This increases assembly time and may increase the number of components.

SUMMARY OF THE INVENTION AND ADVANTAGES

The present invention provides a pedal arm and switch assembly for use in a vehicle. The assembly comprises a pedal arm having a pivotal connection for moving through a defined path about the pivotal connection and at least one switch for producing an electronic signal upon actuation in response to the pedal arm reaching a predetermined position in the path. A switch housing supporting the switch. The invention is characterized by a switch housing integral with the pedal arm being an integral member of a single and continuous material.

Accordingly, the present invention provides a brake pedal assembly the switch in a housing which is integral with the pedal arm so that the switch does not need to be attached exteriorly to the pedal arm during installation of the brake assembly into the vehicle.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
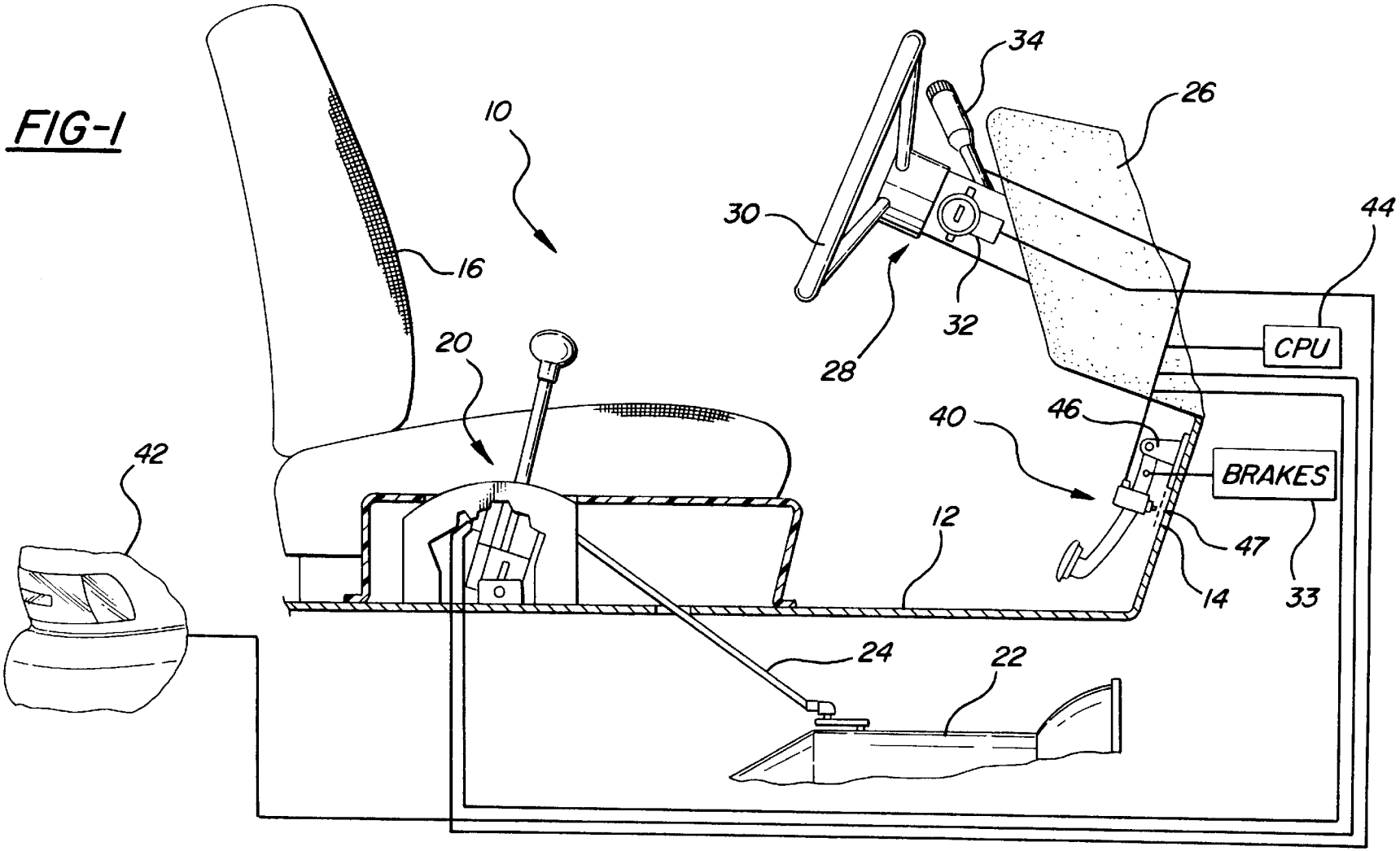
FIG. 1 is a partial view of an interior of a vehicle with a plurality of devices shown schematically.

Referring to FIG. 1, a portion of an interior of a vehicle is shown at 10. The interior 10 includes a floor 12 with an adjoining firewall 14 that serves as a barrier between the engine and passenger compartments. A passenger seat 16 is supported on the floor 12 as is a transmission gear shifter 20 located next to the seat 16. The gear shifter 20 is typically connected to a transmission 22 by a push-pull mechanism 24 that shifts the transmission 22 between park and the forward and reverse gears.

An instrument panel 26 projects from the firewall 14 toward the passenger seat 16 and also serves as a support for the steering column 28 and its attached steering wheel 30. Located on the steering column is an ignition switch 32 which starts the vehicle when certain parameters are met, as discussed below. As an alternative to the gear shifter 20 being located on the floor 12, sometimes referred to as a center console, the gear shifter may be located on the steering column. A cruise control device 34 is attached to the steering column 28 opposite the ignition switch 32 and is used to maintain the vehicle speed when set. Of course, the particular arrangement of the components within the vehicle may vary.

The vehicle also includes a pedal arm and switch assembly 40 used for a plurality of control devices. One such device is the brakes 33 used to decelerate the vehicle and other devices include the transmission gear shifter 20, cruise control 34, and brake lights 42, discussed in more detail below. These control devices 20,34,42 may be electrically connected to the vehicle's computer, or CPU 44. However, the present invention may also be used for clutch pedals and the control devises associated therewith.

Figure 2:
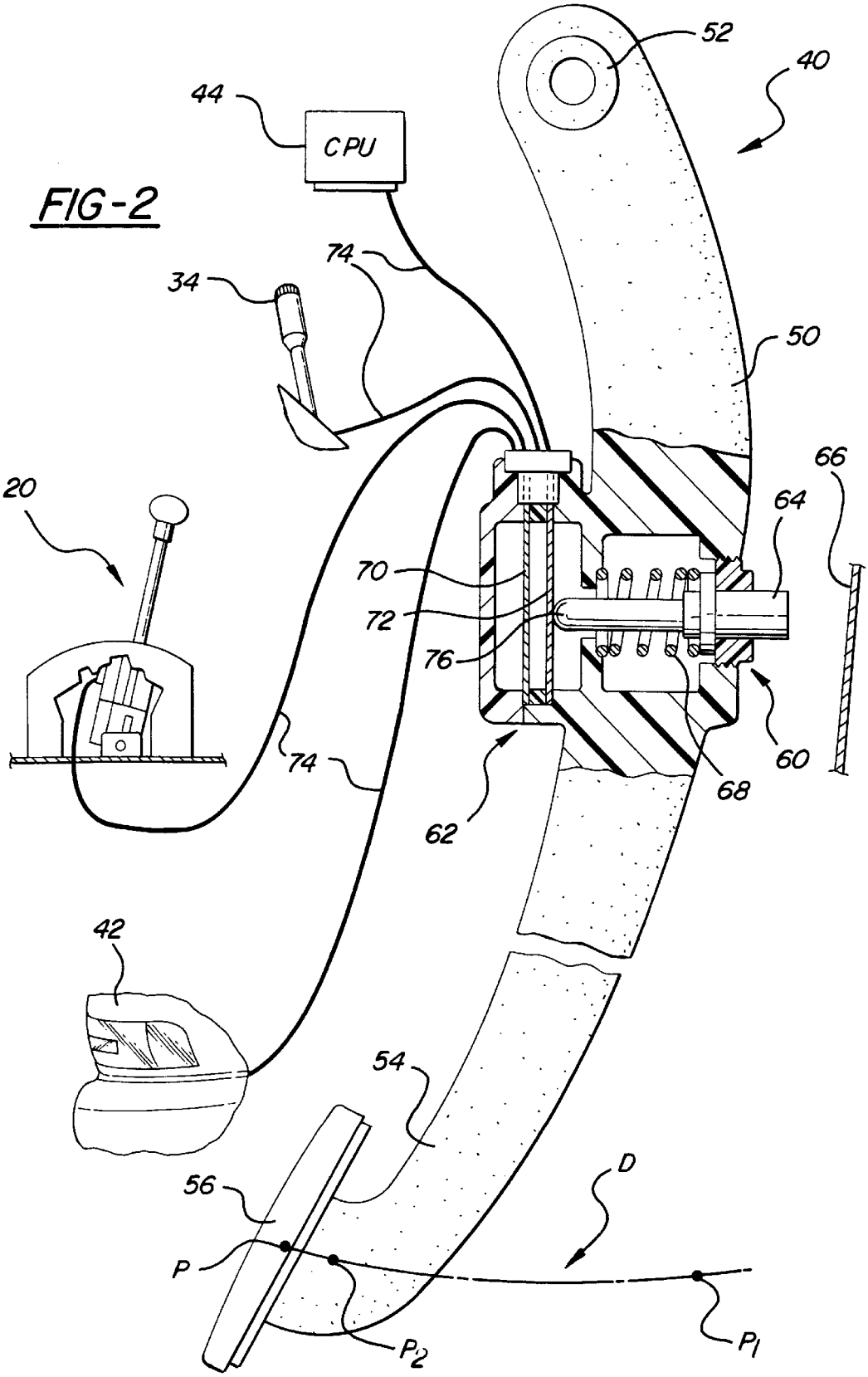
FIG. 2 is a side elevational view partially broken away and in cross-section of the pedal arm and switch assembly of the present invention.

A bracket 46 is attached to the firewall 14 and is used to support the pedal arm and switch assembly 40. As best seen in FIG. 2, the assembly 40 includes a pedal arm 50 and is supported by the bracket 46 at a pivotal connection 52 such that the pedal arm 50 moves through a defined path or arc D about the pivotal connection 52. The pedal arm 50 has a distal end 54 and a pad 56 supported thereon that is operated by a vehicle occupant's foot to move the pedal arm 50 through the defined path D. The pedal arm 50 is normally biased to a position P farthest away from the firewall 14 where the brakes are not applied. To apply the brakes, the occupant would apply force to the pad 56 and move the pedal arm 50 toward the firewall 14.

The assembly 40 also includes at least one switch 60 for producing an electronic signal upon actuation in response to the pedal arm 50 reaching a predetermined position in the defined path D. The switch 60 is contained within a switch housing 62 that is integral with the pedal arm 50. Both the pedal arm 50 and switch housing 62 may be molded of plastic.

The switch 60 includes a pin 64 protruding from the switch housing 62 for actuating the switch 60 to produce the electronic signal. The pin 64 is in a spaced apart relationship from an adjacent surface 66 when the pedal arm 50 is in the normally biased position P. The electronic signal is produced when the pedal arm 50 is moved through the path D and the arm 50 comes in close enough proximity to the surface 66 such that the pin 64 engages the surface 66. The bracket 46 may extend to a portion 47, as shown in FIG. 1. Either the bracket portion 47 or the firewall 14 may provide the engagement surface for the pin 64.

Any type of switch may be used that is capable of being actuated without having an end of the switch fixed to the firewall 14, bracket 46, or other surface. Said another way, it is important that the "free end" of the switch 60, or the end that extends from the pedal arm 50, does not have to be attached to another component in order to function. Thus, it becomes possible to install the pedal arm and switch assembly 40 into a vehicle at the bracket without requiring another attachment point.

In the embodiment shown in FIG. 2, a push pin-type switch 60 is installed in the switch housing 62 with the pin 64 biased outward by a return spring 68. Two parallel contacts 70,72 are arranged in the housing 62 transversely to the pin 64. Lead wires 74 are attached to the contacts 70,72 and are connected to one or more of the control devices

20,34,42. An interior end 76 of the pin 64 abuts one of the contacts 72. When the pin 64 engages the adjacent surface 66 and is depressed, the contacts 70,72 are forced into abutting relationship, thus closing the circuit and sending an electronic signal. Of course, the switch 60 shown is only meant to be illustrative because different vehicles and different customers will have differing requirements. Also, the term "electronic signal" is intended to include switches that are normally closed or switches that are normally open. That is, the switch 60 can be normally closed and then opened upon the pin 64 being depressed by the adjacent surface 66 thus sending an electronic signal to a control device 20,34, 42.

Since different control devices may be actuated at varying predetermined positions along the pedal arm path D, more than one switch may be contained in the housing, each producing a signal at differing predetermined positions. Alternatively, a single switch may be used that is capable of producing a signal at more than one predetermined position. The term "predetermined position" only is meant to indicate the point at which the signal is first produced. That is, the signal may continue to be produced throughout a portion of the defined path D of the pedal arm 50 after the predetermined position is reached or, alternatively, produce a signal only the moment the predetermined position is reached.

Vehicle control devices are often controlled, in part, by other devices. For example, the transmission gear shifter 20 is in part controlled by a first predetermined position P1 of the pedal arm and switch assembly 40, that corresponds to the assembly 40 being in a fully depressed position. Modern transmissions 22 cannot be shifted out of park and into gear unless the brakes 33 are actuated and the ignition switch 32 is turned to a run position in which the vehicle's engine is running. An electronic signal will be sent when the assembly 40 is in the first predetermined position P1, thus enabling the transmission gear shifter 20 to shift the transmission 20 out of park and into gear. This safety feature prevents the transmission 22 from inadvertently being shifted into gear thereby permitting the vehicle to roll.

Unlike the transmission gear shifter 20, the cruise control 34 and brake lights 42 are controlled by a second predetermined position P2. The second predetermined position P2 is between the normally biased position P and the fully depressed position P1. The cruise control system 34, which sets and maintains the vehicle's speed when activated, is deactivated when the pedal arm 50 reaches the second predetermined position P2 and the electronic signal is produced. Typically, the pedal arm 50 only needs to be depressed slightly to deactivate the cruise control system 34. Thus, the second predetermined position P2 will be close to the normally biased position P.

The brake light system includes brake lights 42 for indicating when the vehicle is decelerating. The brake lights 42 become illuminated when the pedal arm 50 reaches the second predetermined position P2 and the electronic signal is produced. Thus, the electronic signal produced by the switch in the second predetermined position P2 may be used for more than one device.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A pedal arm and switch assembly (40) for use in a vehicle (10) comprising:

a pedal arm (50) having a pivotal connection (52) for moving through a defined path (D) about said pivotal connection (52);

at least one switch (60) for producing an electronic signal upon actuation in response to said pedal arm (50) reaching a predetermined position (P1,P2) in said path (D);

and a switch housing (62) supporting said switch (60); and characterized by said switch housing (62) and said pedal arm (50) being an integral member of a single and continuous material.

2. The assembly as set forth in claim 1 wherein said switch (60) includes a pin (64) for actuating said switch (60) to produce said electronic signal, said pin (64) protruding from said switch housing (62).

3. The assembly as set forth in claim 2 further comprising a bracket (46) for supporting said pedal arm (50) at said pivotal connection (52), said bracket (46) including a surface (47) adjacent said pin (64) for engaging said pin (64) when said pedal arm (50) reaches said predetermined position (P1,P2).

4. The assembly as set forth in claim 1 wherein said material forming said pedal arm (50) and said switch housing (62) comprises plastic.

5. The assembly as set forth in claim 1 wherein said pedal arm (50) includes a distal end (54) and a pad (56) supported on said distal end (54).

* * * * *